US006715709B2

(12) United States Patent
Stephens et al.

(10) Patent No.: US 6,715,709 B2
(45) Date of Patent: Apr. 6, 2004

(54) APPARATUS AND METHOD FOR PRODUCING LOGS OF SHEET MATERIAL

(75) Inventors: Franklin Jerepatrick Stephens, Louden, TN (US); Rustin Michael Holder, Knoxville, TN (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/135,656

(22) Filed: Apr. 30, 2002

(65) Prior Publication Data

US 2003/0201361 A1 Oct. 30, 2003

(51) Int. Cl.[7] ..... B65H 18/20; B65H 19/30

(52) U.S. Cl. ..... 242/533; 242/541.5; 242/542.1; 242/542.2

(58) Field of Search ..... 242/533, 533.2, 242/533.3, 542.1, 542.2, 541.5, 541.6

(56) References Cited

U.S. PATENT DOCUMENTS

| | | | | |
|---|---|---|---|---|
| 1,888,810 A | * | 11/1932 | Sieg | 242/542.1 |
| 3,345,010 A | | 10/1967 | Egan | |
| 3,841,578 A | | 10/1974 | Dörfel | |
| 3,931,940 A | | 1/1976 | Raighn et al. | |
| 4,002,308 A | | 1/1977 | Feighery | |
| 4,280,669 A | | 7/1981 | Leanna et al. | |
| 4,487,377 A | | 12/1984 | Perini | |
| 4,700,642 A | | 10/1987 | Hankinson, Jr. | |
| 5,249,756 A | | 10/1993 | Biagiotti | |
| 5,368,252 A | * | 11/1994 | Biagiotti | 242/542.1 |
| 5,690,296 A | * | 11/1997 | Biagiotti | 242/542.1 |
| 5,839,688 A | | 11/1998 | Hertel et al. | |
| 6,089,496 A | * | 7/2000 | Dorfel | 242/542.1 |
| 6,199,789 B1 | * | 3/2001 | Marco | 242/542.2 |
| 6,260,789 B1 | * | 7/2001 | Cramer | 242/542.1 |

FOREIGN PATENT DOCUMENTS

| | | |
|---|---|---|
| DE | 20102309 | 5/2001 |
| EP | 698570 | 2/1996 |
| GB | 2087362 A | 5/1982 |
| WO | 94/21545 | 9/1994 |
| WO | 98/12134 | 3/1998 |
| WO | 99/32383 | 7/1999 |

* cited by examiner

*Primary Examiner*—John M. Jillions
(74) *Attorney, Agent, or Firm*—Richard M. Shane

(57) ABSTRACT

The present invention provides an apparatus and a method for forming and ejecting logs from the winding cradle of a surface-driven rewinder comprising a winding cradle formed by a plurality of parallel rollers having gaps there between and wherein at least one of the rollers is moveable relative to the others thereby forming first and second gaps of variable length. The rewinder further includes a first driver that is operatively connected to and controls the rotational speed of at least one of the rollers, and a second driver that is operatively connected to and controls the rotational speed of at least one of the rollers, and wherein the rollers driven by the first driver are different than the rollers driven by the second driver. The rotational speed and/or direction of one or more of the rollers can be varied whereby a log of sheet material formed within the winding cradle can be ejected through either the first or second gap.

30 Claims, 4 Drawing Sheets

APPARATUS AND METHOD FOR PRODUCING LOGS OF SHEET MATERIAL

FIELD OF THE INVENTION

The present invention relates to an apparatus and method for forming logs of sheet material in the winding cradle of a rewinder. More particularly, the present invention relates to an apparatus and method for forming logs of sheet material having a desired diameter.

BACKGROUND OF THE INVENTION

In the production of consumer roll goods such as bathroom tissue, paper towels, wipers, or other sheet material, rewinders are used to convert large diameter parent rolls of sheet material into numerous small diameter, narrow width rolls for consumer use. During the rewinding process, the sheet material on the large diameter parent roll is unwound, then rewound into smaller diameter logs. Optional converting steps may include slitting, embossing, and/or perforating.

Rewinders may be continuous or non-continuous. After the formation of a log in a non-continuous rewinder, the rewinder is stopped, the log is ejected, a new set of cores is inserted in the winding cradle, and the rewinder is started again for another cycle. Economics dictate that this cycle time must be as short as possible. In a continuous rewinder, the rewinder may be slowed, but does not come to a complete stop during the ejection of a log.

After a log reaches the target diameter, the log is ejected from the winding cradle so that it may be advanced to a series of further processing steps, for example a packaging step. However, in some instances the log may not reach the target diameter, for example, if the sheet material were to break prior to reaching the target diameter. In this case, the log is still ejected from the winding cradle, but is advanced to a different series of further processing steps, for example a reclaiming step. Therefore, separation of the defective logs from those that achieve the target diameter is needed to help ensure product uniformity.

Mechanical devices such as pushers may be used to eject the finished log from the rewinder. However, mechanical pushers may have a slow cycle time and may require a rather large minimum log diameter before the pusher can be activated to reject the log from the rewinder. If the sheet material web breaks prior to reaching the minimum log diameter, the rewinder operator is often required to re-thread the broken web and build the log to the minimum log diameter before it can be rejected from the rewinder. This can create an enormous amount of wasted time and/or sheet material.

Therefore, there exists a need for an improved rewinder apparatus and an improved method of removing logs from a surface-driven rewinder. In this regard, there exists a need for a rewinder and method that decreases the amount of time that is required to eject a completed log from a surface-driven rewinder. There further exists a need for a rewinder and method that eliminates the need to build a defective log to a minimum diameter prior to rejecting the defective log from a surface-driven rewinder. Still further, there exists a need for a rewinder and method for separating logs of target diameter from defective logs.

SUMMARY OF THE INVENTION

The aforesaid needs are fulfilled and the problems experienced by those skilled in the art overcome by the rewinder of the present invention which, in one aspect, comprises a winding cradle formed by a plurality of parallel rollers wherein at least one of the rollers is moveable relative to the others thereby forming at least two gaps of variable length. The rewinder further comprises a first driver that is operatively connected to and controls the speed of at least one of the rollers; and a second driver that is operatively connected to and controls the speed of at least one of the rollers, wherein the rollers driven by the first driver are different than the rollers driven by the second driver. Further, at least one of the rollers is an ejection roller whereby a log or roll of sheet material formed within the winding cradle can be ejected therefrom to either side of the ejection roller.

In a further aspect, a rewinder for forming logs or rolls of sheet material is provided comprising a winding cradle formed by a plurality of parallel rollers having gaps there between and wherein at least one of the rollers is moveable relative to the others thereby forming first and second gaps of variable length; a first driver that is operatively connected to and controls the rotational speed of at least one of the rollers; a second driver that is operatively connected to and controls the rotational speed of at least one of the rollers and wherein the rollers driven by the first driver are different than the rollers driven by the second driver. This rewinder allows a log or roll of sheet material formed within the winding cradle to be ejected through either the first or second gap.

The first and second drivers may, in one aspect, comprise variable speed drivers. Additionally and/or alternatively, the direction of rotation of at least one of the rollers may be capable of being reversed to eject a log from the winding cradle.

In a particular aspect, the plurality of rollers may comprise first, second and third rollers wherein the first and second gaps adjacent the first roller are of variable length. The first driver may be operatively connected to and control the rotational speed of the first roller and the first driver may be a variable speed driver. The first roller may, in one aspect, be moveable relative to the second and third rollers thereby forming the first and second gaps of variable length. The second gap may have a length between 50% and 200% of the length of the first gap. In a further aspect, the first driver may be operatively connected to and control the rotational speed of the first roller and the first driver may be capable of rotating the first roller in clockwise and counter-clockwise directions.

The rewinder may further include a sheet feeding mechanism and a log starting mechanism wherein the sheet feeding mechanism directs the sheet material into the winding cradle. In one aspect, the sheet material may comprise a paper product. In a further aspect, the rewinder may further comprise at least one roller having an anti-slip surface.

In a further aspect of the present invention, a method of forming a log or roll of sheet material is provided comprising the steps of: (i) directing a sheet material into a winding cradle and forming a log or roll of sheet material, wherein the winding cradle is formed by a plurality of rollers having gaps there between and further wherein at least one of the rollers is moveable relative to the others thereby forming first and second gaps of variable length; (ii) rotating the rollers and the log or roll of sheet material thereby increasing the diameter of the log or roll of sheet material in the winding cradle and wherein the first and second gap lengths increase with the diameter of the log or roll of sheet material; and (iii) ejecting logs or rolls of sheet material having a selected diameter through the first gap and ejecting logs or rolls having a non-selected diameter through the second gap.

In a particular aspect of the present invention, the step of ejecting the log of sheet material may comprise reducing the rotational speed of at least one roller, stopping the rotation of at least one roller, and/or reversing the direction of rotation of at least one roller. In a further aspect, the method may further comprise the step of adjusting the force exerted by at least one of the rollers against the log wherein the roller moves away from the winding cradle to allow the log to eject from the winding cradle.

In a further aspect, the plurality of rollers may comprise a first, second and third rollers wherein the first gap is formed between the first and second roller and the second gap is formed between the first and third roller. Further, the first roller may move away from the second and third rollers as the diameter of the log of sheet material increases. In one aspect, the log of sheet material may be ejected from the winding cradle by altering the rotational speed of the rollers wherein the rotational speed of the first roller exceeds the rotational speed of the second or third rollers. In a further aspect, the log of sheet material may be ejected from the winding cradle by altering the rotational speed of the rollers wherein the rotational speed of the first roller is less than the rotational speed of at least one of the second or third rollers. In still a further aspect of the present invention, logs of sheet material having the selected diameter are ejected through the first gap by altering the rotational speed of the first roller relative to the second or third rollers and logs of sheet material having the non-selected diameter are ejected through the second gap by reversing the direction of one of the rollers relative to the rotational direction used to increase the diameter of the logs of sheet material.

BRIEF DESCRIPTIONS OF THE DRAWINGS

DETAILED DESCRIPTION

The present invention provides an apparatus and method for forming logs of sheet material in the winding cradle of a rewinder. The present invention has application to the rewinding of a variety of sheet materials in roll form that include, but are not limited to, paper, tissue, textiles, nonwovens, films, foils, laminates thereof, and so forth.

During the rewinder operation, the sheet material is unwound from a parent roll of sheet material. Optionally, the sheet material may travel through additional converting operations prior to being rewound into a log. Exemplary optional converting operations include, but are not limited to, slitting, embossing, calendering, perforating, and so forth. After traveling through the optional converting operations, the sheet material enters the winding cradle of a surface-driven rewinder. The winding cradle is the space within the rewinder in which the sheet material is wound into a log.

Figure 1:
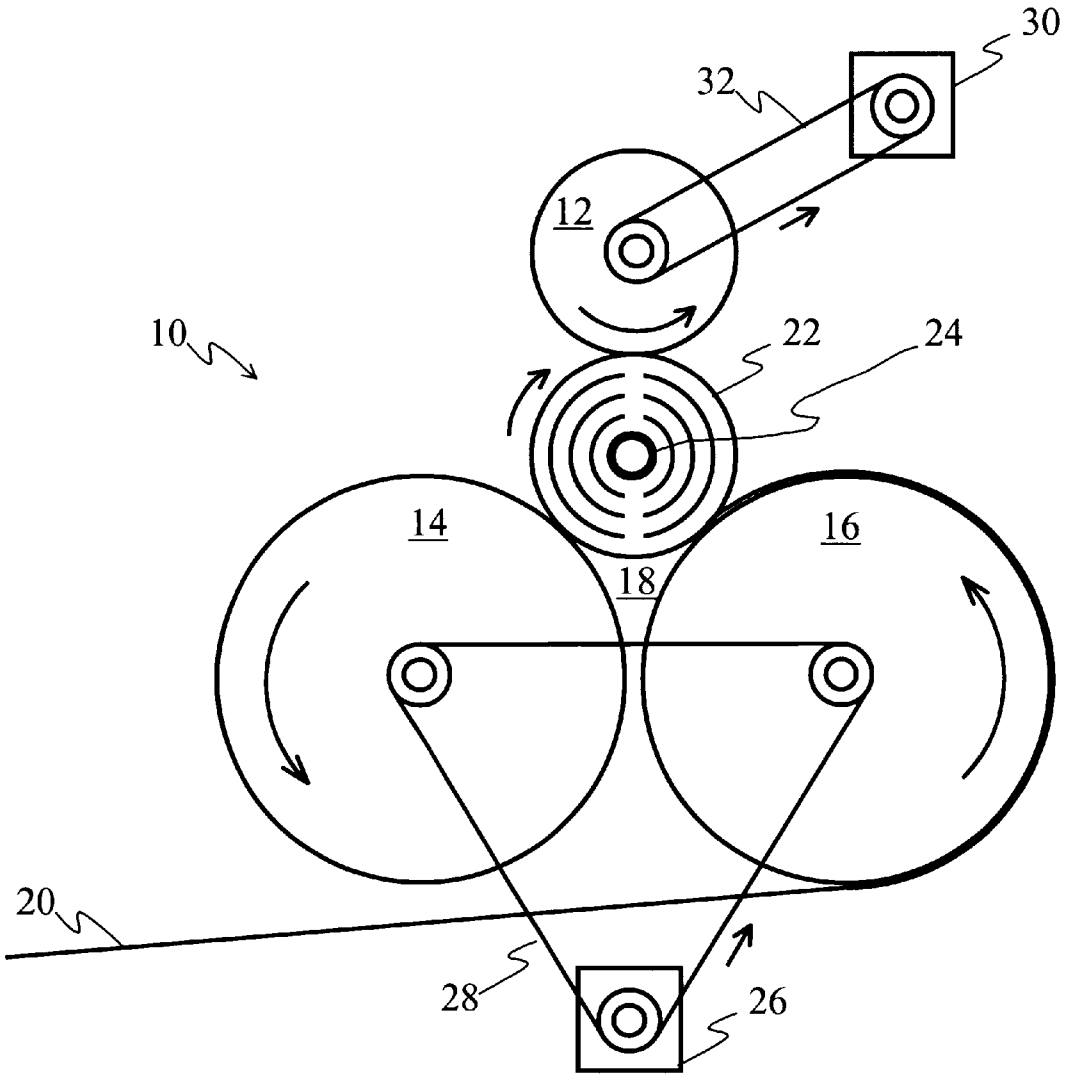
FIG. 1 is a side view of a rewinder of the present invention.

FIG. 1 shows a surface-driven rewinder 10 comprising a three-roller system that includes a first roller 12, a second roller 14, and a third roller 16. The first roller 12, second roller 14, and third roller 16 collectively define the winding cradle 18. The sheet material 20 enters the winding cradle 18 where it is wound into a log 22.

It will be appreciated by those skilled in the art that the rewinder of the present invention may comprise a plurality of rollers that define the winding cradle. Each roller comprises a log-contacting surface, two end faces, and a longitudinal axis that extends through the centers of the roller's end faces. During regular operation of the rewinder, the rollers rotate about the longitudinal axes in the same direction with substantially equivalent surface speeds. The log-contacting surfaces of the rollers act against the outer surface of the log to rotate the log in the direction opposite the rotation of the rollers and wind the sheet material onto the outer surface of the log. Referring again to FIG. 1, a particular embodiment is illustrated in which the first roller 12, the second roller 14, and the third roller 16 rotate counterclockwise as indicated by the arrows, thereby rotating the log 22 in a clockwise direction, also indicated by an arrow. In an alternate embodiment, the rollers may rotate clockwise, thereby rotating the log in a counterclockwise direction.

Referring again to the embodiment depicted in FIG. 1, the log 22 further comprises a core 24 upon which the sheet material 20 is wound. Those skilled in the art will appreciate that the core 24 may comprise a series of narrow-width cores positioned end-to-end to receive individual slits of sheet material. The individual cores have a width substantially equivalent to the width of the corresponding individual slits of sheet material. The surface of the core 24 may support an adhesive to affix the sheet material 20 against the surface of the core 24 as the log 22 begins to form. Those skilled in the art will appreciate that other mechanisms may be utilized to initiate the log formation process within the winding cradle. In other embodiments, the log may be coreless. Other mechanisms known to those skilled in the art may be utilized to initiate the log formation process within the winding cradle when coreless logs are being formed.

Figure 2:
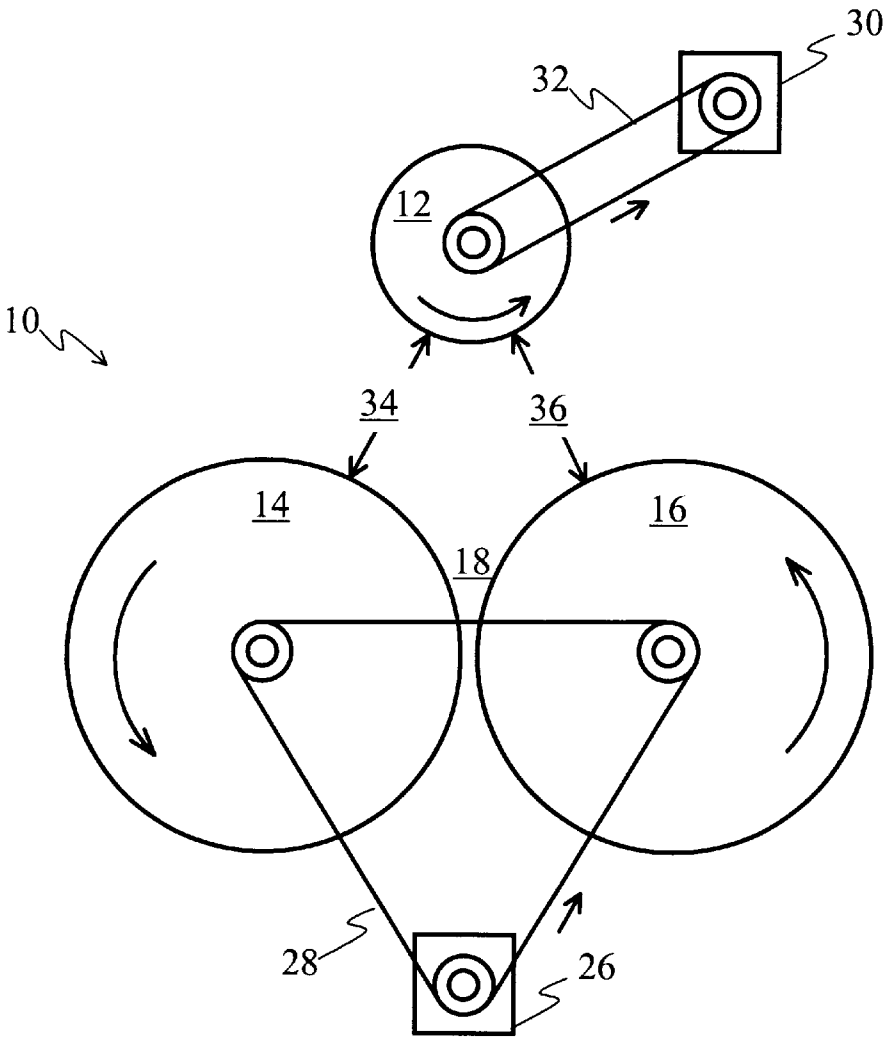
FIG. 2 is a side view of the rewinder of FIG. 1 that depicts the first and second gaps through which a log may be ejected.

In the present invention, the winding cradle comprises at least one roller that has the capability to move away from the center of the log as the log grows in diameter. That is, at least one roller is capable of moving towards or away from the other rollers to allow the log to grow. Capability for a roller to move laterally with respect to adjacent rollers creates gaps having variable lengths between the two adjacent rollers. Therefore, this movement can be utilized to widen the gap between adjacent rollers so that the log may be ejected from the winding cradle through the widened gap. Referring now to FIG. 2, lateral movement of the first roller 12 would result in a first gap 34 and a second gap 36 having variable lengths. Alternatively, the first gap 34 would have variable length if the second roller 14 was moveable, and the second gap 36 would have variable length if the third roller 16 was moveable.

Desirably, during the winding of the log, the movable roller(s) is positioned with respect to the adjacent roller(s) such that smaller of the first gap 34 and the second gap 36 has a length at least about 50% of the larger of the first gap 34 and the second gap 36. More desirably, the movable roller(s) is positioned with respect to the adjacent roller(s) such that smaller of the first gap 34 and the second gap 36 has a length at least about 75% of the larger of the first gap 34 and the second gap 36. Even more desirably, the movable roller(s) is positioned with respect to the adjacent roller(s) such that smaller of the first gap 34 and the second gap 36 has a length at least about 90% of the larger of the first gap 34 and the second gap 36. Even more desirably, the first gap 34 and the second gap 36 have lengths that are of substantially equivalent length.

Exemplary mechanisms that provide for movement of a roller include, but are not limited to, tracks that engage and support the ends of the roller such that the ends of the roller can move within the tracks, or pivoting arms that engage and support the ends of the roller, and so forth. Those skilled in the art will appreciate that numerous additional mechanisms are available for providing lateral movement of the rollers.

In the present invention, at least one of the rollers that comprise the winding cradle is an ejection roller designated as such because the rewinder has the capability to eject a log within the winding cradle of the rewinder to either side of the ejection roller. The ejection roller may or may not be capable of moving laterally with respect to the center of the log. If the ejection roller is capable of lateral movement, then it may be that no other such roller is required. If the ejection roller is not capable of lateral movement, then the rollers adjacent to the ejection roller must be capable of movement sufficient to allow the gap between the ejection roller and the adjacent roller to be increased to the point where the log can be ejected through the gap.

During the formation of a log, each of the rollers that comprise the winding cradle exerts a force against the log at the point of contact between the log-contacting surface of the respective rollers and the log. The forces exerted by the rollers against the log have radial components directed towards the center of the log. The radial component of the force exerted by a roller capable of lateral movement may be adjusted by a force adjuster. Exemplary force adjusters include, but are not limited to, springs, pneumatic cylinders, air bladders, and so forth slidingly engaged against the periphery of the rollers. As will be appreciated by one skilled in the art, the force applied against the log may be adjusted to control the hardness of the log as it forms. Increasing the force applied against the log tends to increase the hardness of the log, while decreasing the force applied against the log tends to decrease the hardness of the log.

Additionally, the forces exerted by the rollers comprising the winding cradle against a log have a tangential component directed against the surface of the log at the point of contact between log-contacting surface of the respective rollers and the log. It is the tangential components of the forces that cause the log to rotate so that the sheet material is wound onto the outside surface of the log.

Desirably, at least one of the rollers comprises an anti-slip surface on the log-contacting surface and even more desirably, at least two or more of the rollers comprise an anti-slip surface on the log-contacting surface. The anti-slip surface increases the coefficient of friction against the surface of the log, thereby increasing the tangential force exerted by the roller against the surface of the log and improving the ability of the roller to eject or reject the log. Examples of anti-slip surfaces include, but are not limited to, textured finishes, engraved patterns, rubber coatings, grit tape, and so forth.

The rewinder of the present invention comprises a first driver that is operatively connected to and controls the speed of at least one of the rollers. The first driver may be operatively connected to the rollers it drives by a first transmission that may include, but is not limited to, a series of belts, pulleys, gears, gear boxes, planetary gear boxes, sprockets, combinations thereof, and so forth. The first driver may rotate one or more rollers. Additionally, the rewinder has a second driver that is operatively connected to and controls the speed of at least one of the rollers independently of the first driver. The second driver may be operatively connected to the rollers it drives by a first transmission that may include, but is not limited to, a series of belts, pulleys, gears, gear boxes, planetary gear boxes, sprockets, combinations thereof, and so forth. The second driver may rotate one or more rollers. However, the rollers driven by the second driver may be different than the rollers driven by the first driver. Examples of drivers suitable for the present invention include, but are not limited to, servomotors, frequency drives, and so forth. Desirably, the first driver and/or the second driver provide fast responding control of the rollers that they drive respectively. More desirably, the first driver and/or second driver provide fast responding control of the rollers that they drive respectively in either forward or reverse direction. Even more desirably, the first driver and/or second driver provide substantially instantaneous step-change control of the roller speeds.

Referring again to the embodiment depicted in FIG. 1, a first driver 26 is operatively connected to the second roller 14 and third roller 16 by a first transmission 28. A second driver 30 is operatively connected to the first roller 12 by a second transmission 32. The second driver 28 and second transmission 32 provide independent control over the speed and rotation direction of the first roller 12.

Optionally, the rewinder of the present invention may comprise a sheet material break sensor that detects a break in the sheet material during the rewinding process. Examples of sheet material break sensors include but are not limited to tension detectors, tension controllers, motion detectors, photo-eyes and so forth. The output from the sheet material break sensor may be used to initiate the rejection of the defective log when the sheet material breaks. A microprocessor or other device may be used to monitor the output from the sheet material break sensor and control the log rejection sequence.

Optionally, the rewinder of the present invention may comprise a log diameter sensor that detects when the target log diameter has been attained or that detects lack of change in the log diameter that could be indicative of a sheet material break. Additionally or alternatively, the rewinder may comprise a tachometer, the output of which can be integrated to determine the total length of sheet material that has been rewound onto the log. The output from the log diameter sensor, tachometer or other device may be used to initiate the ejection of a finished log when the target diameter or length is reached or to initiate the rejection of a defective log in the event of a sheet material break. The microprocessor or other device may be used to monitor the output from the diameter sensor or tachometer and control the log ejection sequence.

Figure 3:
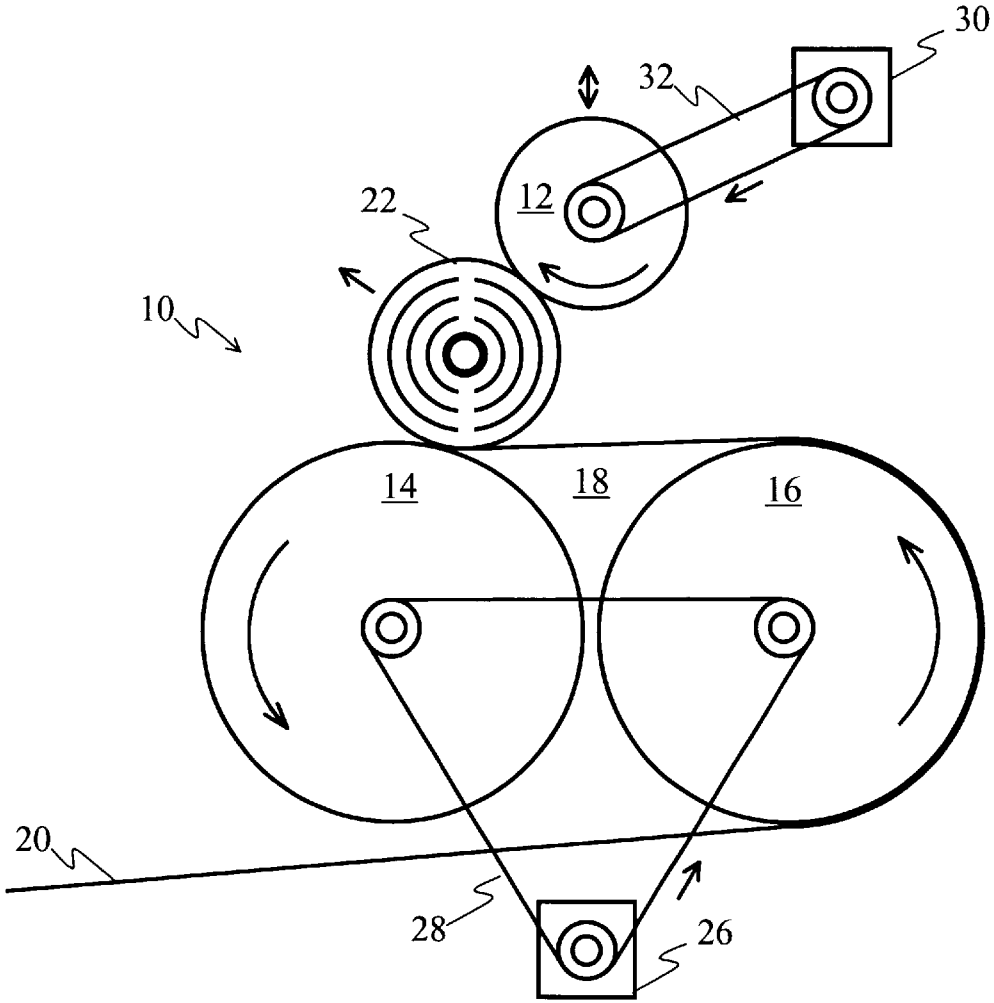
FIG. 3 is a side view of the rewinder of FIG. 1 that depicts the ejection of a log having the target diameter to a first side of the ejection roller.

The apparatus of the present invention may be employed to eject the finished log for further processing to either side of the ejection roller. By controlling the relative speeds of the rollers that comprise the winding cradle, speed differentials between the rollers can be created and employed to move the log out of the winding cradle to either side of the ejection roller. Referring again to FIG. 1, when it is necessary to eject the log 22 from the winding cradle 18, the speed of the first roller 12 may be slowed such that the surface speeds of the second roller 14 and the third roller 16 are greater than the surface speed of the first roller 12. The speed differential between the first roller 12 and the second roller 14 causes the log 22 to be ejected between the first roller 12 and the second roller 14. Alternatively and desirably, referring now to FIG. 3, when it is necessary to eject the log 22 from the winding cradle 18, the direction of rotation of the first roller 14 may be reversed such that the action of the log-contacting surfaces of the first roller 12, second roller 14, and third roller 16 in the winding cradle 18 act to eject the log 22 between the first roller 12 and the second roller 14.

As the surface speed and/or direction of rotation of the first roller 12 is adjusted, it is important to allow at least one of either the first roller 12 or the second roller 14 to move away from the winding cradle 18 to enlarge the space between the first roller 12 and the second roller 14 through which the log 22 can pass. This can be accomplished by maintaining or reducing the force exerted by at least one of either the first roller 12 or the second roller 14 against the log 22 so that the log 22 pushes at least one of either the first roller 12 or the second roller 14 out of the way as the log 22 is ejected from the winding cradle 18. In a desired embodiment, the first roller 12 is capable of moving laterally relative to the second roller 14 and third roller 16 to allow the log 22 to eject between the first roller 12 and the second roller 14.

In some situations, it may be desirable to slow the second roller 14 and/or the third roller 16 prior to or as ejecting the log 22. In this event, ejection of the log 22 is accomplished by even further slowing of the first roller 12. In other situations, it may be desirable to bring the second roller 14 and the third roller 16 to a stop prior to ejecting the log 22. In these situations it would be necessary to reverse the direction of rotation of the first roller 12 to eject the log 22 between the first roller 12 and the second roller 14.

It is also possible to reject a log by the aforementioned method prior to its reaching the target diameter or length. However, this may have the disadvantage of ejecting the defective log into the same area as the logs that have reached the target diameter or length.

Figure 4:
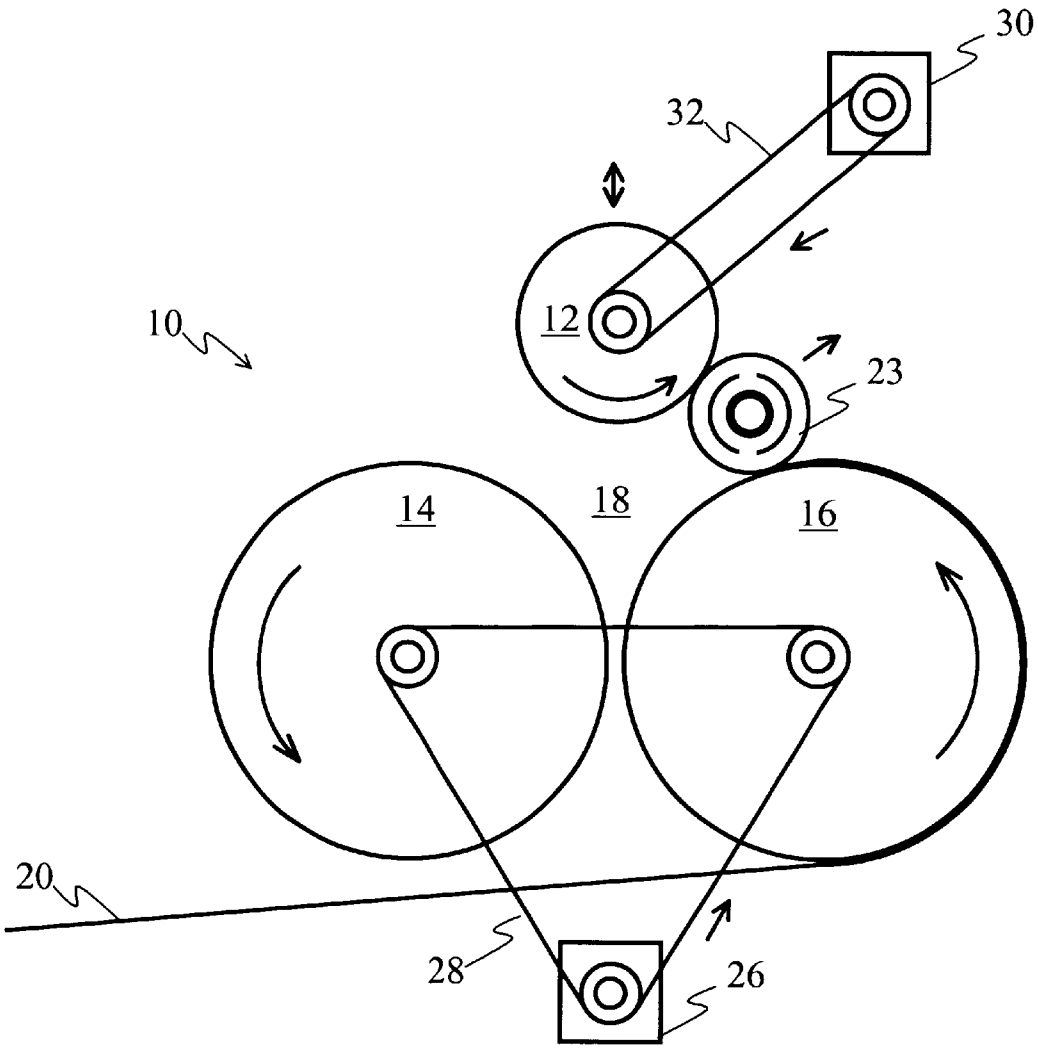
FIG. 4 is a side view of the rewinder of FIG. 1 that depicts the ejection of a defective log to a second side of the ejection roller.

In order to ensure that logs achieving the target diameter or length are kept separate from the defective logs, it is often desirable that the defective logs be ejected to the other side of the ejection roller. Referring now to FIG. 4, slowing, stopping, or reversing the rotation of the third roller 16, or alternatively, the second roller 14 and third roller 16, can cause the defective log 23 to be ejected between the first roller 12 and the third roller 16. Because a log may be ejected to either side of the first roller 12, the first roller 12 is considered an ejection roller. When slowing or stopping the third roller 16, or alternatively, the second roller 14 and third roller 16, the action of the log-contacting surface of the first roller 12 that is still rotating at full speed causes the defective log 23 to be ejected between the first roller 12 and the third roller 16. By reversing the direction of rotation of the second roller 14 and third roller 16, the action of the log-contacting surfaces of all three rollers in the winding cradle 18 act to eject the defective log 23 between the first roller 12 and the third roller 16. Again, it is important to allow at least one of either the first roller 12 or the third roller 16 to move away from the winding cradle 18 to enlarge the space between the first roller 12 and the third roller 16 through which the defective log 23 can pass. This can be accomplished by maintaining or reducing the force exerted by at least one of either the first roller 12 or the third roller 16 against the defective log 23 so that the defective log 23 pushes at least one of either the first roller 12 or the third roller 16 out of the way as the defective log 23 is ejected from the winding cradle 18. In a desired embodiment, the first roller 12 is capable of moving to allow the defective log 23 to eject between the first roller 12 and the third roller 16.

While the invention has been described in detail with respect to specific embodiments thereof, it will be apparent to those skilled in the art that various alterations, modifications and other changes may be made without departing from the spirit and scope of the present invention. It is therefore intended that all such modifications, alterations and other changes be encompassed by the claims.

We claim:

1. A rewinder for forming logs of sheet material comprising:

a winding cradle formed by a plurality of parallel rollers having gaps there between;

a first driver that is operatively connected to and controls the speed of at least one of the rollers; and a second driver that is operatively connected to and controls the speed of at least one of said rollers and wherein said rollers driven by said first driver are different than the rollers driven by said second driver; and wherein at least one of said rollers is moveable relative to the others thereby forming at least two gaps of variable length, and wherein the direction of rotation of at least one of said rollers is capable of being reversed such that the log contacting surfaces of the plurality of rollers act to eject the log from the winding cradle , and wherein at least one of said rollers is an ejection roller whereby a log of sheet material formed within said winding cradle can be ejected therefrom to either side of said ejection roller.

2. The rewinder of claim 1 wherein the first and second drivers comprise variable speed drivers.

3. The rewinder of claim 1 wherein the plurality of rollers comprise first, second and third rollers and further wherein the first and second gaps adjacent said first roller are of variable length.

4. The rewinder of claim 3 wherein said first driver is operatively connected to and controls the rotational speed of the first roller and wherein said first driver is a variable speed driver.

5. The rewinder of claim 3 wherein said first roller is moveable relative to said second and third rollers thereby forming said first and second gaps of variable length.

6. The rewinder of claim 3 wherein said second gap has a length between about 50% and about 200% of the length of the first gap.

7. The rewinder of claim 3 wherein said first driver is operatively connected to and controls the rotational speed of the first roller and further wherein the first driver is capable of rotating said first roller in clockwise and counter-clockwise directions.

8. The rewinder of claim 1 wherein said sheet material comprises a paper product.

9. The rewinder of claim 1 wherein at least one roller further comprises an anti-slip surface.

10. A rewinder for forming logs of sheet material comprising:

a winding cradle formed by a plurality of parallel rollers having gaps there between and wherein at least one of said rollers is moveable relative to the others thereby forming first and second gaps of variable length;

a first driver that is operatively connected to and controls the rotational speed of at least one of the rollers; and a second driver that is operatively connected to and controls the rotational speed of at least one of said rollers and wherein said rollers driven by said first driver are different than the rollers driven by said second driver; and wherein the direction of rotation of at least one of said rollers is capable of being reversed such that the log contacting surfaces of the plurality of rollers act to elect the log from the winding cradle, and wherein a log of sheet material formed within said winding cradle can be ejected through either said first or second gap.

11. The rewinder of claim 10 wherein the first and second drivers comprise variable speed drivers.

12. The rewinder of claim 10 wherein said second gap has a length between about 50% and about 200% of the length of the first gap.

13. The rewinder of claim 10 wherein the plurality of rollers comprises first; second and third rollers and further wherein said variable length first and second gaps are adjacent said first roller.

14. The rewinder of claim 13 wherein said first driver is operatively connected to and controls the rotational speed of the first roller and wherein said first driver is a variable speed driver.

15. The rewinder of claim 13 wherein said first roller is moveable relative to said second and third rollers thereby forming said gaps of variable length.

16. The rewinder of claim 13 wherein said first driver is operatively connected to and controls the rotational speed of the first roller and further wherein the first driver is capable of rotating said first roller in clockwise and counter-clockwise directions.

17. The rewinder of claim 10 wherein said sheet material comprises a paper product.

18. The rewinder of claim 10 wherein at least one roller includes an anti-slip surface.

19. A method of forming a log of sheet material having a selected diameter comprising the steps of:

directing a sheet material into a winding cradle and forming a log of sheet material, wherein said winding cradle is formed by a plurality of rollers having gaps there between and further wherein at least one of said rollers is moveable relative to the others thereby forming first and second gaps of variable length;

rotating said rollers and said log of sheet material thereby increasing the diameter of said log of sheet material in said winding cradle and wherein said first and second gap lengths increase with the diameter of said log of sheet material;

ejecting logs of sheet material having a selected diameter through said first gap and ejecting logs having a non-selected diameter through said second gap.

20. The method of claim 19 wherein the step of ejecting a log of sheet material comprises reducing the rotational speed of at least one roller.

21. The method of claim 19 wherein the step of ejecting a log of sheet material comprises stopping the rotation of at least one roller.

22. The method of claim 19 wherein the step of ejecting a log of sheet material comprises reversing the direction of rotation of at least one roller.

23. The method of one of claim 19 further comprising the step of adjusting the force exerted by at least one of the rollers against the log wherein the roller moves away from the winding cradle to allow the log to eject from the winding cradle.

24. The method of claim 19 wherein the logs of selected diameter are ejected through said first gap by reducing the rotational speed of at least one roller.

25. The method of claim 24 wherein the logs of non-selected diameter are ejected through said second gap by reversing the rotational direction of at least one roller.

26. The method of claim 19 wherein said plurality of rollers comprises a first, second and third rollers and wherein said first gap is formed between said first and second roller and said second gap is formed between said first and third roller.

27. The method of claim 26 wherein said first roller moves away from said second and third rollers as the diameter of said log of sheet material increases.

28. The method of claim 26 wherein said log of sheet material is ejected from said winding cradle by altering the rotational speed of said rollers wherein the rotational speed of said first roller exceeds the rotational speed of the second or third rollers.

29. The method of claim 26 wherein said log of sheet material is ejected from said winding cradle by altering the rotational speed of said rollers wherein the rotational speed of said first roller is less than the rotational speed of at least one of the second or third rollers.

30. The method of claim 26 wherein said logs of sheet material having the selected diameter are ejected through said first gap by altering the rotational speed of said first roller relative to the second or third rollers and further wherein said logs of sheet material having the non-selected diameter are ejected through said second gap by reversing the direction of one of said rollers relative to the rotational direction used to increase the diameter of the log of sheet material.

* * * * *